US005455990A

United States Patent [19]

Genevray

[11] Patent Number: 5,455,990

[45] Date of Patent: Oct. 10, 1995

[54] DEVICE FOR CLEANING MOREL CYLINDERS ON A CARD

[75] Inventor: Henri Genevray, Guebwiller, France

[73] Assignee: N. Schlumberger et Cie, S.A., Guebwiller, France

[21] Appl. No.: 246,103

[22] Filed: May 19, 1994

[30] Foreign Application Priority Data

May 19, 1993 [FR] France ..... 93 06277

[51] Int. Cl.[6] ..... D01G 15/98; D01G 15/94

[52] U.S. Cl. ..... 19/108; 19/84

[58] Field of Search ..... 19/84, 108, 109

[56] References Cited

U.S. PATENT DOCUMENTS

| | | | |
|---|---|---|---|
| 318,121 | 5/1885 | Klein | 19/84 X |
| 725,836 | 4/1903 | Garsed et al. | 19/108 |
| 2,009,282 | 7/1935 | Thibeau | 19/84 |
| 2,115,605 | 4/1938 | Allen et al. | 19/84 X |
| 2,189,519 | 2/1940 | Harrison et al. | 19/84 |
| 2,536,589 | 1/1951 | Blank . | |
| 2,742,673 | 4/1956 | Pettit et al. . | |
| 2,816,324 | 12/1957 | Brown et al. | 19/108 X |
| 3,234,599 | 2/1966 | Reiterer | 19/108 |
| 5,259,092 | 11/1993 | Lambe et al. | 19/109 |

FOREIGN PATENT DOCUMENTS

| | | |
|---|---|---|
| 892111 | 3/1962 | United Kingdom . |
| WO91/09164 | 6/1991 | WIPO . |

*Primary Examiner*—John J. Calvert
*Attorney, Agent, or Firm*—Young & Thompson

[57] ABSTRACT

Device for cleaning Morel cylinders of a wool card, comprising a tool carrier (1) displaceable along the Morel cylinder (2). The tool carrier (1) is mounted on a carriage (3) displaceable on a tube (4), extending parallel to the axis of the Morel cylinder (2), and comprises at one end a cleaner (5) in the form of a semi-rigid self-cleaning covering and/or rigid steel blades and at its other end a counter-weight (6). The tool carrier (1) is mounted pivotally on the carriage (3) by a shaft (7) fixed on the carriage (3), and the cleaner is flexibly urged against the Morel cylinder (2) by the counter-weight (6). The upper surface of the cleaner (5) is turned toward the Morel cylinder (2) and coacts with the spiral winding of the covering of the Morel cylinder (2) such that the rotation of this latter gives rise to an axial displacement of the tool carrier (1) and of the cleaner (5).

11 Claims, 4 Drawing Sheets

DEVICE FOR CLEANING MOREL CYLINDERS ON A CARD

FIELD OF THE INVENTION

The present invention relates to the field of textile industry, particularly wool cards, and especially the cleaning of the Morel cylinders of these latter, and has for its object a device for cleaning the Morel cylinders of a wool card.

BACKGROUND OF THE INVENTION

So that such a card can operate under good conditions and with acceptable output, it is necessary that all the cylinders be correctly and regularly cleaned, and this without danger for the operator or operators.

At present, the cleaning of the Morel cylinders is effected manually. To this end, an operator performs the cleaning by means of a stripping tool with rigid blades held in the hand and displaced over all the length of the cylinder, so that this operation will be effective over all the width of working of the machine. To this end, the operator stands above the rotating cylinder, which renders the operation difficult, dangerous or even perilous, because he could fall on the rotating roller of the card and thus be the victim of an extremely grave accident.

Moreover, this manual cleaning method requires also dismounting the tray, the burr-beater and the transfer rollers, which gives rise to a relatively long period of careful work and, as a corollary, high cost.

These various drawbacks are the principal cause of irregular cleaning, which is most often carried out only at the last possible moment. Moreover, this cleaning operation requires that the operator remain at the work site, so that he cannot perform other work.

SUMMARY OF THE INVENTION

The present invention has for its object to overcome these drawbacks.

It thus has for its object a cleaning device for the Morel cylinders of a wool card, characterized in that it is essentially constituted by a tool holder displaceable below the Morel cylinder along the complete length and removably mounted.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 1:
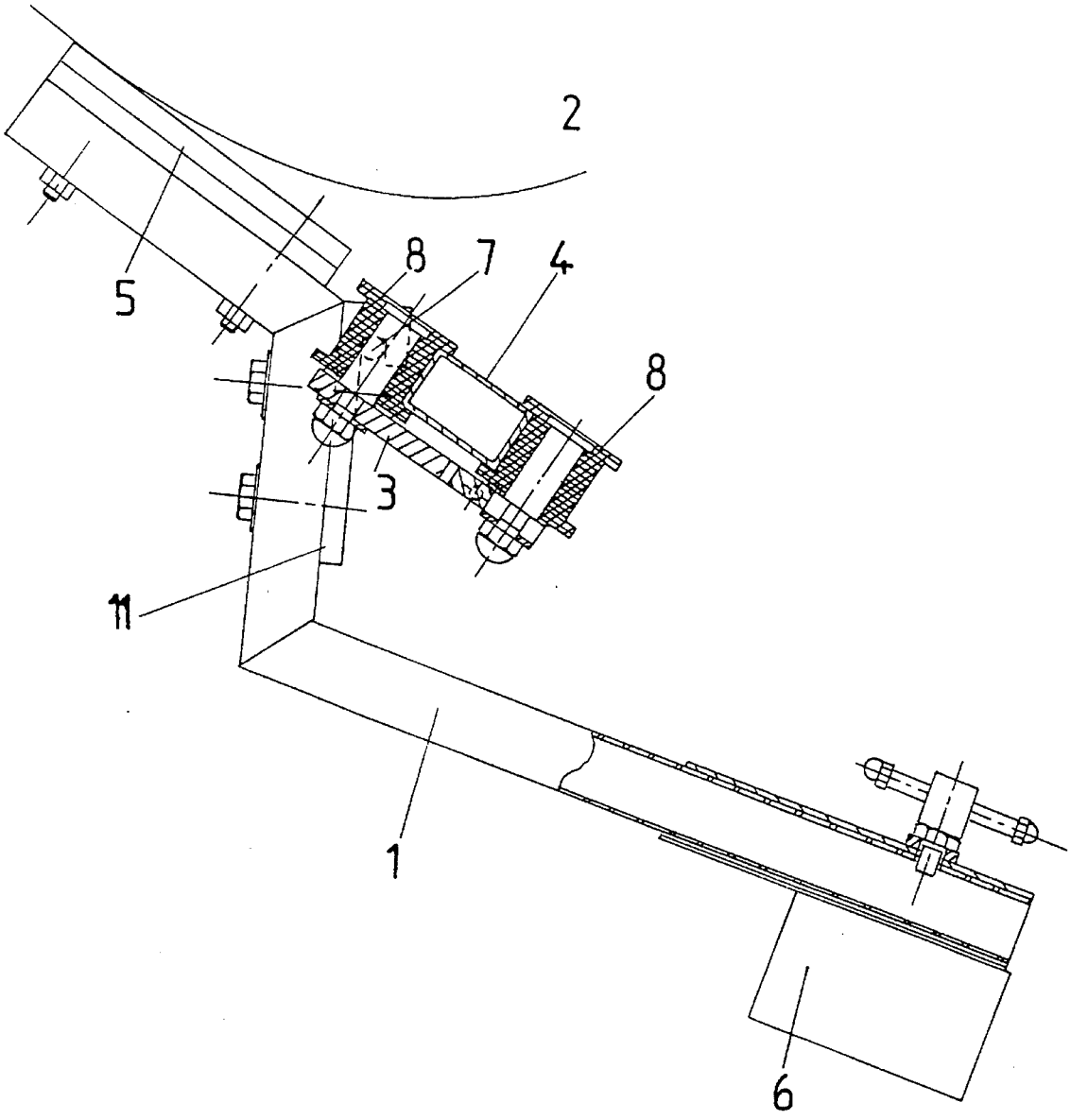
FIG. 1 is a side elevational view, partially in cross section, of the device according to the invention.
Figure 2:
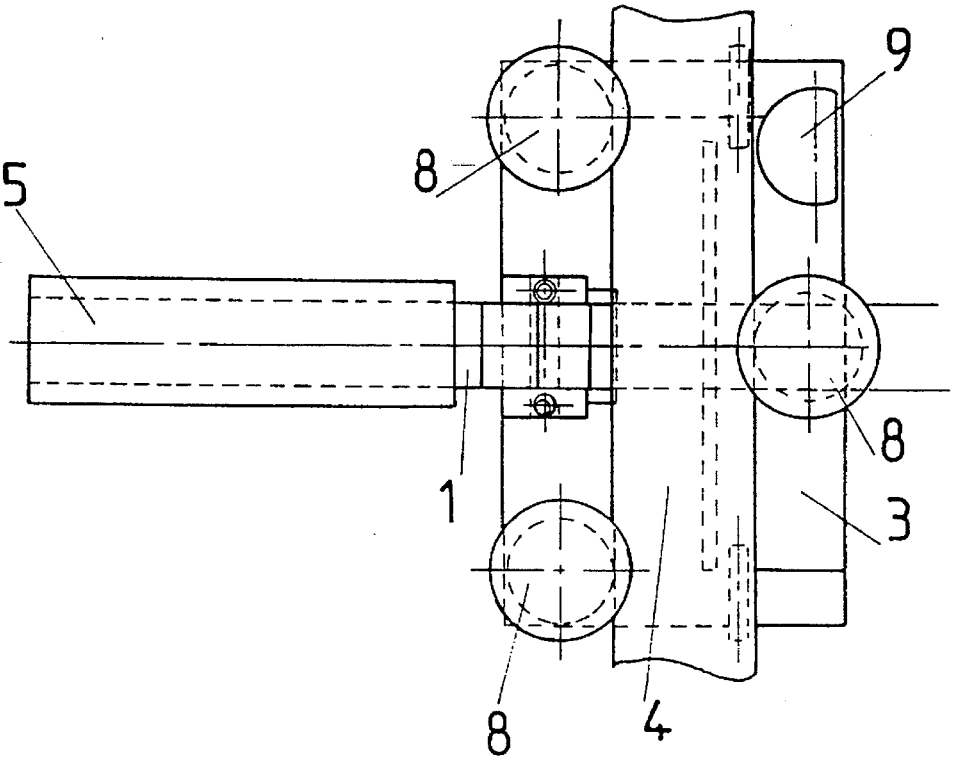
FIG. 2 is a view from above of the displacement means for the cleaner.
Figure 3:
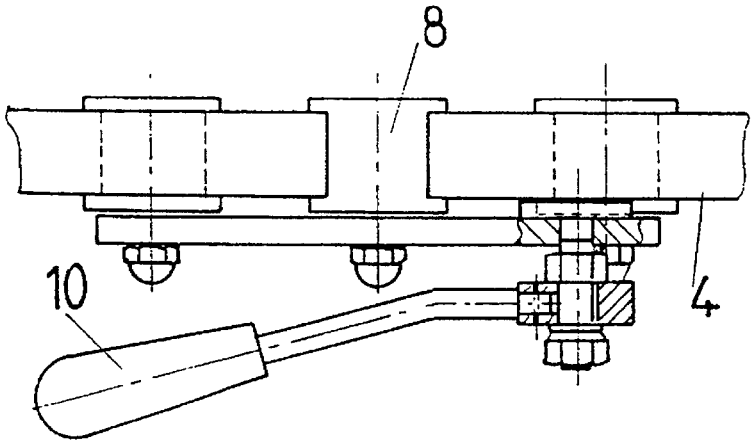
FIG. 3 is a view from below of the locking mechanism of the carriage bearing the cleaner.

According to the invention and as shown more particularly by way of example in FIG. 1 of the accompanying drawings, the cleaning device of the Morel cylinders of a wool card is essentially constituted by a tool carrier 1 displaceable below the Morel cylinder 2 along its complete length, and removable.

The tool carrier 1 is mounted on a carriage 3 displaceable along a tube 4, extending parallel to the axis of the Morel cylinder 2, and comprises at one end a cleaner 5 in the form of a semi-rigid self-cleaning facing and/or rigid steel blades and at its other end a counter-weight 6.

The tool carrier 1 is pivotally mounted on the carriage 3 by means of a shaft 7 fixed on said carriage 3 and coacts in a removable manner with said shaft 7 by means of a clamping device 11. This mounting provides a hinge connection between the tool carrier 1 and the carriage 3.

The carriage 3 is guided on the tube 4 by means of rollers 8 and is lockable along said tube 4 by means of a cam 9 actuated by means of a lever 10. Moreover, the upper surface of the cleaner 5 turned toward the Morel cylinder 2 is driven by the spiral winding of the covering of said Morel cylinder 2, such that the rotation of this latter gives rise to an axial displacement of the tool carrier 1 of the cleaner 5.

The cleaning device according to the invention operates in the following manner:

Under the force of the counter-weight 6, the cleaner 5 is brought to bear against the covering of the Morel cylinder 2 so as to clean it. During rotation of the Morel cylinder 2, its spiral wound covering overlaps the covering of the cleaner 5, such that this latter is displaced along the Morel cylinder as a generatrix, and along all the width of the machine.

Figure 4:
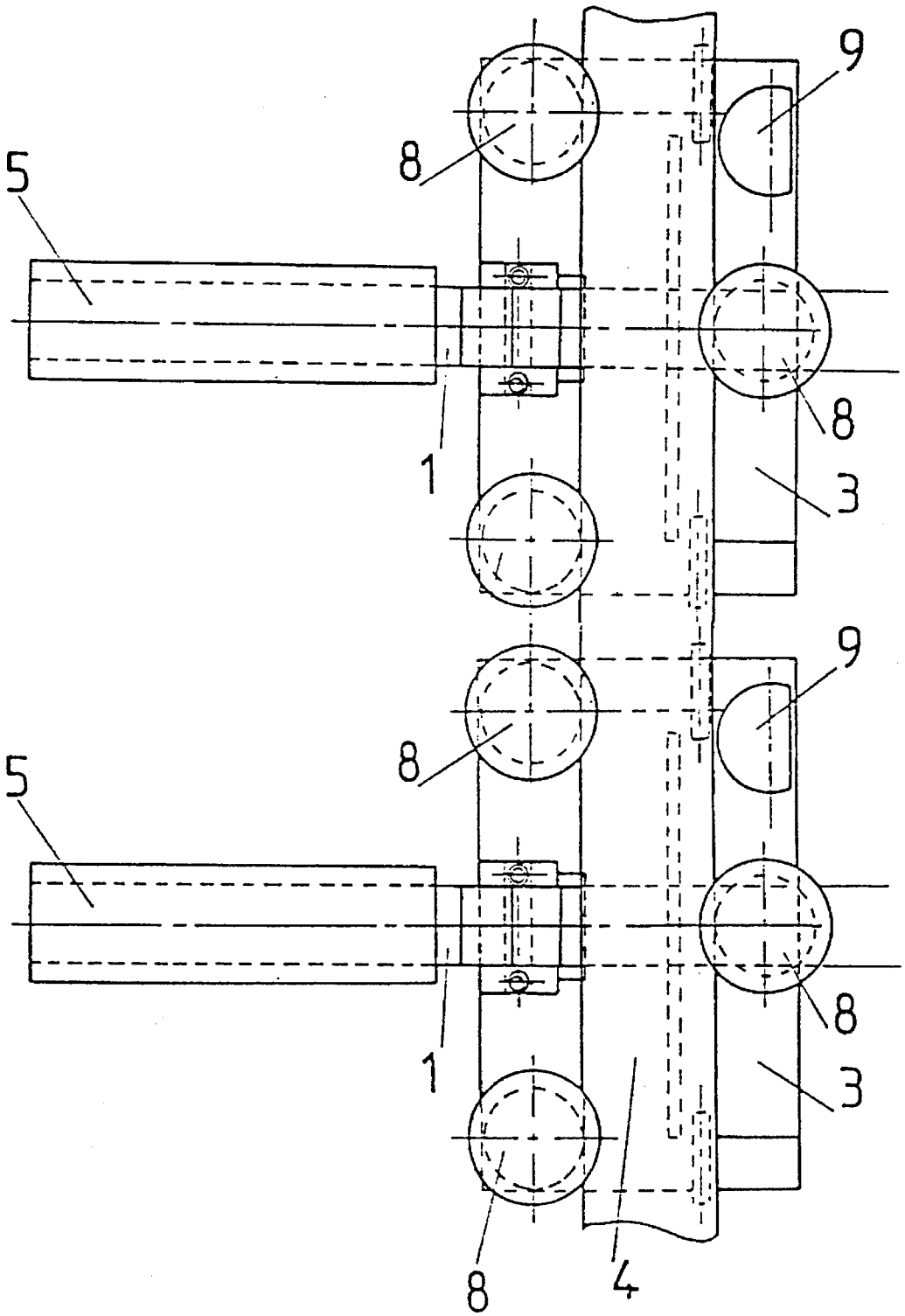
FIG. 4 is a view from above of the displacement means for plurality of cleaners.

As a function of the effectiveness of cleaning that is sought, it is possible to use several tool carriers 1 with cleaners 5 below a single Morel cylinder 2, as depicted in FIG. 4. When the tool carriers 1 with the cleaner 5 arrive at the end of their cleaning path, the operator raises the tool carriers by the counter-weights 6 and displaces the carriages 3 back to the starting point.

Figure 5:
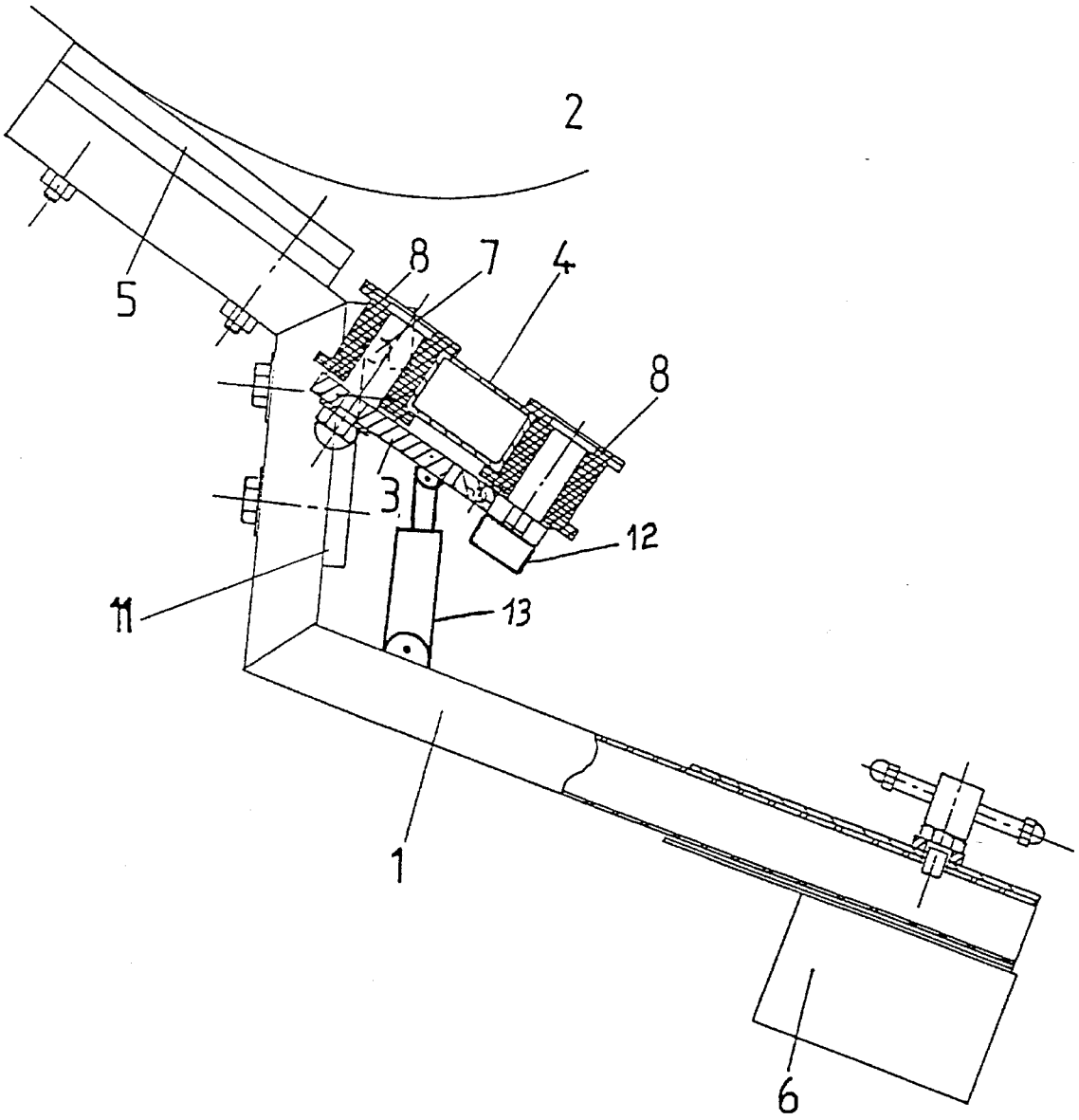
FIG. 5 is a side elevational view, partially in cross section, of the device according to another embodiment of the invention.

According to a modified embodiment of the invention, as shown in FIG. 5 of the accompanying drawings, the cleaning device can be automated by the provision on the carriage 3 of motorized means 12 acting on the guide tube 4, a pivoting means 13 for the tool carrier 1, acting on this latter in the direction of disengagement of the cleaner 5 from contact with the Morel cylinder 2, being also provided on the carriage 3. This pivoting means 13 may preferably be present in the form of a jack or an electro-magnet. Thus, when the cleaning device arrives at the end of its cleaning path, an end-of-path contact can trigger, on the one hand, the pivoting of the tool carrier so as to disengage the cleaner 5 and, on the other hand, the actuation of displacement means for the carriage 3, a new cleaning cycle being adapted to be started by an end-of-path contact disposed beside the starting point for cleaning.

The present invention provides a cleaning device of Morel cylinders perfected and semi-automated or totally automatic, such that the cleaning operation permits an important saving of time, and such that the operator can perform other work in the time saved, and as a consequence the overall output of the machine is considerably improved.

Moreover, the cleaning is effected in a much more regular manner, such that the quality of the cleaning and, because of this, the quality of the exiting product, are as constant as possible.

Moreover, the operator not being obliged to remain next to the machine to effect manual cleaning, any danger or risk of accident is lessened, which improves safety.

Moreover, the automatic cleaning permits avoiding dismounting the tray, the burr-beater and the transfer rollers, such that the work of the operator is lightened.

Of course the invention is not limited to the embodiment described and shown in the accompanying drawings. Modifications remain possible, particularly as to the construction of the different elements or by substitution of technical equivalents, without thereby departing from the scope of protection of the invention.

What is claimed is:

1. Device for cleaning Morel cylinders of a wool card, comprising a plurality of tool carriers, each tool carrier carrying a cleaning tool for the Morel cylinder, said tool carriers being disposed below the Morel cylinder, and means mounting the tool carrier for movement along the Morel cylinder in a direction parallel to an axis of rotation of the Morel cylinder.

2. Device according to claim 1, wherein each tool carrier (1) is mounted on a carriage (3) displaceable on a tube (4) extending parallel to the axis of the Morel cylinder (2) and comprises at one end a cleaner (5) and at another end a counter-weight (6).

3. Device according to claim 2, wherein each tool carrier (1) is pivotally mounted on the carriage (3) via a shaft (7) fixed on the carriage (3) and is removably secured to said shaft (7) by a clamping device (11).

4. Device according to claim 2, wherein the carriage (3) is guided on the tube (4) by rollers (8) and is lockable along said tube (4) by a cam (9) actuated by a lever (10).

5. Device according to claim 2, wherein each cleaner has an upper surface which is turned toward the Morel cylinder (2) and coacts with a spiral winding of a covering of said Morel cylinder (2), so that the rotation of the Morel cylinder gives rise to an axial displacement of each tool carrier (1) and of each cleaner (5).

6. Device for cleaning Morel cylinders of a wool card, comprising a tool carrier carrying a cleaning tool for the Morel cylinder, means for moving the tool carrier along the Morel cylinder in a direction parallel to an axis of rotation of the Morel cylinder, said moving means comprising a carriage displaceable on a tube extending parallel to the axis of the Morel cylinder, said carriage including motorized means for acting on the tube, and pivoting means for acting on the tool carrier in a direction of disengagement of the cleaner out of contact with the Morel cylinder, said tool carrier having a cleaner at one end and a counterweight at another end.

7. Device according to claim 6, wherein the pivoting means for the tool carrier (1) is a jack.

8. Device according to claim 6, wherein the pivoting means for the tool carrier (1) is an electro-magnet.

9. Device for cleaning Morel cylinders of a wool card, comprising a tool carrier carrying a cleaning tool for the Morel cylinder, means for moving the tool carrier along the Morel cylinder in a direction parallel to an axis of rotation of the Morel cylinder, said moving means comprising a carriage displaceable on a tube extending parallel to the axis of the Morel cylinder, said tool carrier having a cleaner at one end and a counterweight at another end, said tool carrier being pivotally mounted on the carriage via a shaft fixed on the carriage, and being removably secured to the shaft by a clamping device.

10. Device according to claim 9, wherein the carriage is guided on the tube by rollers and is lockable along said tube by a cam actuated by a lever.

11. Device according to claim 9, wherein the cleaner has an upper surface which is turned toward the Morel cylinder and coacts with a spiral winding of a covering of said Morel cylinder, so that the rotation of the Morel cylinder gives rise to an axial displacement of the tool carrier and of the cleaner.

* * * * *